US007798602B2

(12) United States Patent
Kobayashi et al.

(10) Patent No.: US 7,798,602 B2
(45) Date of Patent: Sep. 21, 2010

(54) INK-JET HEAD, INK-JET PRINTER HAVING THE INK-JET HEAD AND PRINTING METHOD

(75) Inventors: Hisayuki Kobayashi, Suwanee, FL (US); Shinichi Uehara, Komoro (JP); Masaru Ohnishi, Kawanishi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 501 days.

(21) Appl. No.: 11/505,247

(22) Filed: Aug. 16, 2006

(65) Prior Publication Data

US 2007/0188547 A1 Aug. 16, 2007

(30) Foreign Application Priority Data

Aug. 16, 2005 (JP) ..... 2005-235615

(51) Int. Cl.
*B41J 23/00* (2006.01)

(52) U.S. Cl. ..... 347/37

(58) Field of Classification Search ..... 347/16, 347/98, 101, 105, 15
See application file for complete search history.

(56) References Cited

U.S. PATENT DOCUMENTS

2003/0142168 A1* 7/2003 Suzuki et al. ..... 347/43
2005/0083363 A1* 4/2005 Ishikawa et al. ..... 347/15

FOREIGN PATENT DOCUMENTS

JP 2002-205381 7/2002

* cited by examiner

*Primary Examiner*—Stephen D Meier
*Assistant Examiner*—Alexander C Witkowski
(74) *Attorney, Agent, or Firm*—Ditthavong Mori & Steiner, P.C.

(57) ABSTRACT

An ink-jet printer includes an ink-jet head. The ink-jet head has an image printing head and a ground-color-layer printing head. The image printing head is configured to print an image on a medium and has at least one image printing ink discharge port. The ground-color-layer printing head is configured to print a ground-color-layer on the medium and has at least one ground-color-layer printing ink discharge port. The medium and the ink-jet head are configured to relatively move parallel to a first line and along a second direction substantially perpendicular to the first line. A position of the ground-color-layer printing ink discharge port is displaced from a position of the at least one image printing ink discharge port along the first line and the second direction.

13 Claims, 8 Drawing Sheets

INK-JET HEAD, INK-JET PRINTER HAVING THE INK-JET HEAD AND PRINTING METHOD

CROSS-REFERENCE TO RELATED APPLICATIONS

The present application claims priority under 35 U.S.C. §119 to Japanese Patent Application No. 2005-235615, filed Aug. 16, 2005, entitled "INK-JET PRINTER AND PRINTING METHOD USING IT." The contents of this application are incorporated herein by reference in their entirety.

BACKGROUND OF THE INVENTION

1. Field of the Invention

The present invention relates to an ink-jet printer, a printing method and an ink-jet head.

2. Discussion of the Background

When a color image for advertisement or the like is printed on such a medium as a transparent window glass or a transparent film by using an ink jet printer, it is impossible to directly print an image including the color image on the medium with ink droplets jetted from an ink jet head. Usually, in such a case, a ground-color layer of, for example, white is first printed on the transparent medium with ink droplets for printing a ground-color layer jetted from an ink jet head. Then, an image is printed over the front surface of the ground-color layer with ink droplets for printing an image jetted from another ink jet head. That is, printing is performed twice on the medium, with the ground-color layer and the image printed over each other.

In this way, an image including a color image is printed on a transparent medium with the interposition of a ground-color layer, with the image printed over the ground-color layer. This is because if the image is solely and directly printed on the transparent medium, high-brightness intermediate colors of the image, such as gray other than high-density colors such as red, blue, yellow, and black, for example, are disturbed by lights infiltrating in the image through the transparent medium and thus are not precisely expressed.

Similarly, when a color image for advertisement or the like is printed on the back surface of a transparent medium, an image is printed on the back surface of the medium with ink droplets for printing an image jetted from an ink jet head, and thereafter a ground-color layer of, for example, white is printed over the back surface of the image printed on the medium. In this way, the ground-color layer is printed over the back surface of the image including a color image, which has been printed on the medium. This is also because if the image is solely and directly printed on the back surface of the transparent medium, high-brightness intermediate colors of the image, such as gray other than high-density colors such as red, blue, yellow, and black, for example, are disturbed by lights infiltrating in the image through the transparent medium and thus are not precisely expressed, when viewed through the transparent medium from the front surface side of the medium.

Further, when an image is printed by an ink jet printer on such a medium as fabric, a metal plate, or leather which is difficult to be directly and stably printed with an image including a color image, an image-fixing undercoat layer is printed on the medium with ink droplets for printing an undercoat layer jetted from an ink jet head, and thereafter an image is printed over the front surface of the undercoat layer with ink droplets for printing an image jetted from another ink jet head. That is, printing is performed twice on the medium, with the undercoat layer and the image printed over each other.

Further, when an image is printed on such a medium as a metal plate or leather which is difficult to be stably fixed and printed with an image including a color image, the image is printed on the medium with ink droplets for printing an image jetted from an ink jet head, and thereafter an overcoat layer is printed over the front surface of the image, which has been printed on the medium, with ink droplets for printing an overcoat layer jetted from another ink jet head. The overcoat layer covers and protects the front surface of the image to prevent the image from being scraped off from scrubbing or to prevent the image from having color fading under ultraviolet light.

Therefore, for printing an image including a color image on the front or back surface of a transparent medium by using an ink jet printer, the ink jet printer includes a main ink jet head for jetting ink droplets for printing an image, and also a sub ink jet head for jetting ink droplets of, for example, white for printing a ground-color layer, with the two ink jet heads aligned with each other. Thus, a ground-color layer is printed on the front surface of the transparent medium with the ink droplets jetted from the sub ink jet head, and thereafter an image is printed over the front surface of the ground-color layer with the ink droplets jetted from the main ink jet head. Alternatively, conversely, an image is printed on the back surface of the transparent medium with the ink droplets jetted from the main ink jet head, and thereafter a ground-color layer is printed over the back surface of the image, which has been printed on the medium, with the ink droplets jetted from the sub ink jet head.

Further, for printing an image on such a medium as a metal plate or leather which is difficult to be stably fixed and printed with an image including a color image, an ink jet printer includes a main ink jet head for jetting ink droplets for printing an image, and also a sub ink jet head for jetting ink droplets for printing an overcoat layer, with the two ink jet heads aligned with each other. Thus, an image is printed on the medium, which is difficult to be fixed with an image, with the ink droplets jetted from the main ink jet head, and thereafter an overcoat layer is printed over the front surface of the image, which has been printed on the medium, with the ink droplets jetted from the sub ink jet head. The overcoat layer covers and protects the front surface of the image to prevent the image from being scraped off from scrubbing.

Meanwhile, in the above-described case wherein the ink jet printer which includes the sub ink jet head in addition to the main ink jet head, with the two ink jet heads aligned with each other, is used for printing an image on a transparent medium with the interposition of a ground-color layer, for printing an image on a medium which is difficult to be directly printed with an image, with the interposition of an undercoat layer, for printing a ground-color layer over the back surface of an image printed on the medium, and for printing an overcoat layer over the front surface of an image printed on the medium, as described above, the sub ink jet head which jets the ink droplets for printing a ground-color layer or an undercoat layer is caused to perform a reciprocating movement along a line Y parallel to the horizontal direction, and the medium is sent forth and moved on a platen by sending unit in the front direction of an X direction.

Alternatively, the main ink jet head which jets the ink droplets for printing an image is caused to perform a reciprocating movement along the line Y corresponding to the horizontal direction, and the medium is sent forth and moved on the platen by the sending unit in the rear direction of the X direction. Thus, the ground-color layer, the undercoat layer, or the image is printed at a desired position on the medium. Then, after the ground-color layer or the undercoat layer has been printed on the medium, or after the image has been printed on the medium, a part of the medium placed on the platen is nipped between a grid roller and a pinch roller of the sending unit, and the grid roller is rotated in the reverse direction. Thus, the medium is moved and returned on the platen by the sending unit in the direction opposite to the X direction corresponding to the direction of sending forth the medium. Thus, the main ink jet head which jets ink for printing an image is positioned above the ground-color layer or the undercoat layer previously printed on the medium, or the sub ink jet head which jets ink for printing a ground-color layer or an overcoat layer is positioned above the image previously printed on the medium. Then, the ink droplets for printing an image are jetted from the main ink jet head, or the ink droplets for printing a ground-color layer, an undercoat layer, or an overcoat layer are jetted from the sub ink jet head.

In such a case, while the pinch roller of the sending unit is pressed to contact the front surface of the ground-color layer, the front surface of the undercoat layer, or the back surface of the image, which has been previously printed on the medium, the pinch roller is rolled and moved on the ground-color layer, the undercoat layer, or the image to return in the direction opposite to the direction of sending forth the medium. Therefore, a trace of the pinch roller is left on the ground-color layer, the undercoat layer, or the image, and thus the quality of the image printed over the surface of the ground-color layer or the undercoat layer and the image printed on the medium is substantially deteriorated.

Japanese Unexamined Patent Application Publication No. 2002-205381 discloses an ink jet printer which includes a monochromatic print unit for ejecting ink drops of one color from a plurality of nozzles arranged in an ink jet head, and an overlap printing unit for moving and resetting the ink jet head above the print start part on the surface of a recording medium printed with a specified sectional length of a drawing or character every time when the specified sectional length of a monochromatic drawing or character is printed in the X direction on the surface of the recording medium by the monochromatic print unit and printing a monochromatic diagram or a character of a different color from a previously printed drawing or character on the surface of the recording medium printed with the specified sectional length of a drawing or character by the monochromatic print unit and dried not to cause any blur. The contents of this publication are incorporated by reference in their entirety.

SUMMARY OF THE INVENTION

According to one aspect of the present invention, an ink-jet printer includes an ink-jet head. The ink-jet head has an image printing head and a ground-color-layer printing head. The image printing head is configured to print an image on a medium and has at least one image printing ink discharge port. The ground-color-layer printing head is configured to print a ground-color-layer on the medium and has at least one ground-color-layer printing ink discharge port. The medium and the ink-jet head are configured to relatively move parallel to a first line and along a second direction substantially perpendicular to the first line. A position of the ground-color-layer printing ink discharge port is displaced from a position of the at least one image printing ink discharge port along the first line and the second direction.

According to another aspect of the present invention, an ink-jet printer has an ink-jet head and a jetting controller. The ink-jet head has an image printing head and a ground-color-layer printing head. The image printing head is configured to print an image on a medium and has a plurality of image printing ink discharge ports. The ground-color-layer printing head is configured to print a ground-color-layer on the medium and has a plurality of ground-color-layer printing ink discharge ports. The medium and the ink-jet head are configured to relatively move parallel to a first line and along a second direction substantially perpendicular to the first line. A position of a part of the plurality of ground-color-layer printing ink discharge ports is displaced from a position of a part of the plurality of image printing ink discharge ports along the first line and the second direction. The jetting controller is configured to jet from the part of the plurality of ground-color-layer printing ink discharge ports and the part of the plurality of image printing ink discharge ports.

According to further aspect of the present invention, a printing method includes printing a ground-color-layer on a medium using an ink-jet head, and printing an image on the ground-color-layer printed on the medium using the ink-jet head which includes an image printing head and a ground-color-layer printing head. The image printing head has at least one image printing ink discharge port. The ground-color-layer printing head has at least one ground-color-layer printing ink discharge port. The medium and the ink-jet head are configured to relatively move parallel to a first line and along a second direction substantially perpendicular to the first line. A position of the at least one ground-color-layer printing ink discharge port is displaced from a position of the at least one image printing ink discharge port along the first line and the second direction.

According to yet another aspect of the present invention, an ink-jet head includes an image printing head and a ground-color-layer printing head. The image printing head is configured to print an image on a medium and has at least one image printing ink discharge port. The ground-color-layer printing head is configured to print a ground-color-layer on the medium and has at least one ground-color-layer printing ink discharge port. The medium and the ink-jet head are configured to relatively move parallel to a first line and along a second direction substantially perpendicular to the first line. A position of the at least one ground-color-layer printing ink discharge port is displaced from a position of the at least one image printing ink discharge port along the first line and the second direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
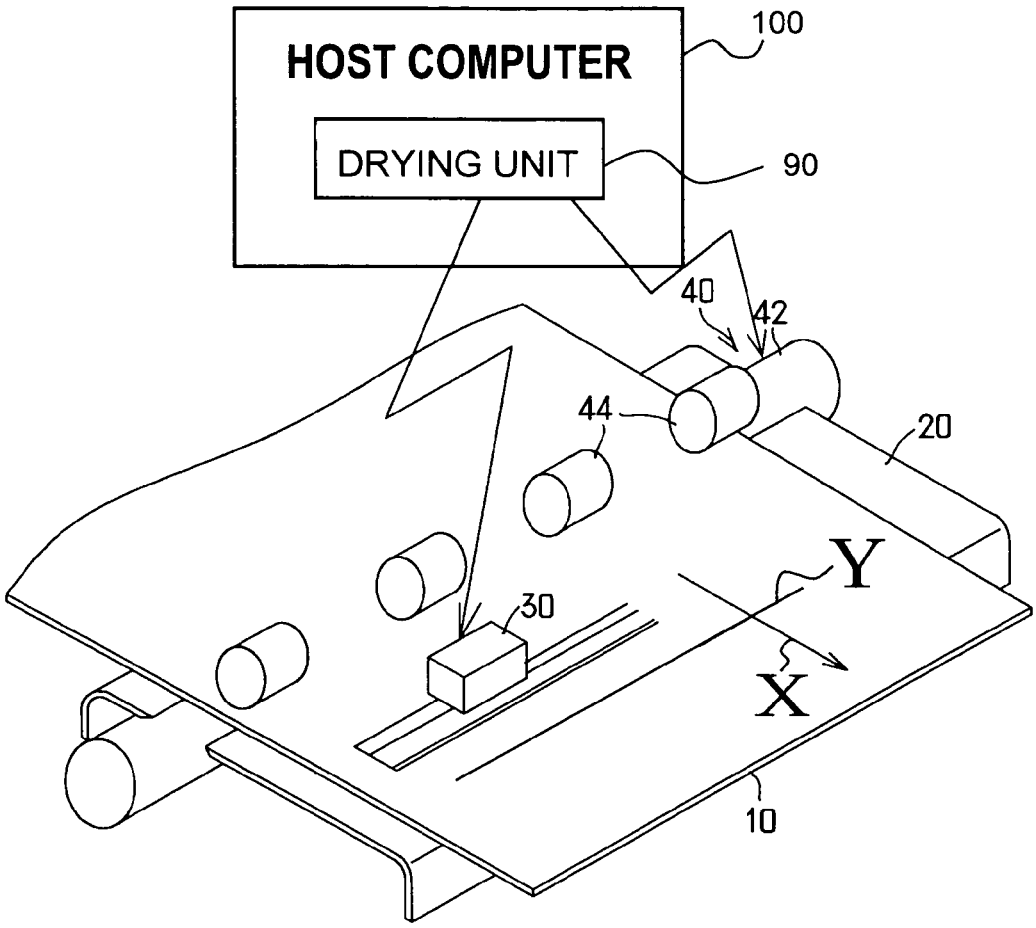
FIG. 1 is a perspective view illustrating a schematic structure of a printer according to an embodiment of the present invention.

The embodiments will now be described with reference to the accompanying drawings, wherein like reference numerals designate corresponding or identical elements throughout the various drawings.

Figure 2:
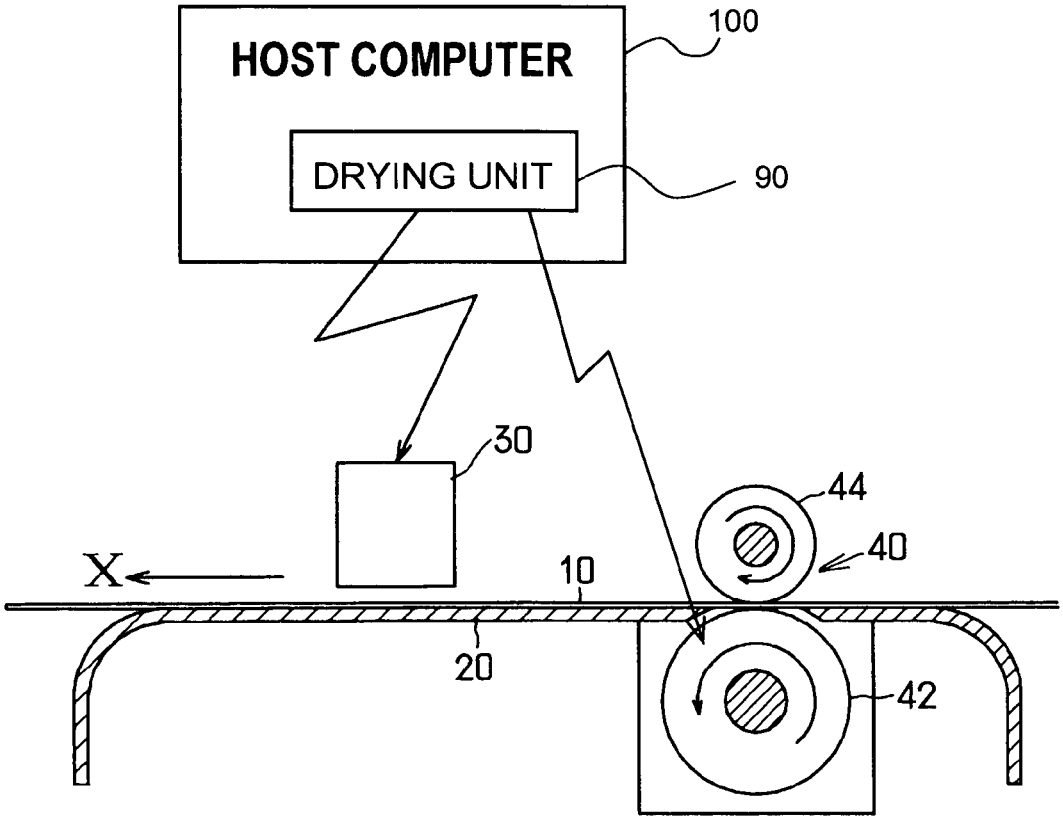
FIG. 2 is a sectional side view of the printer shown in FIG. 1.
Figure 3:
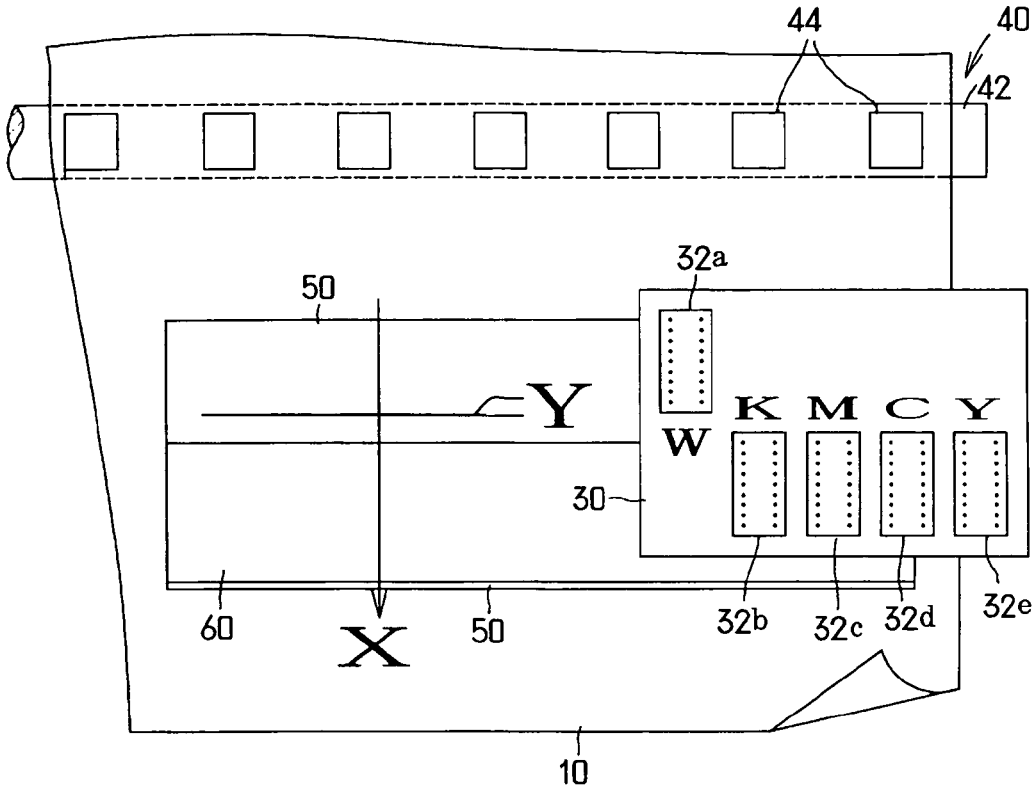
FIG. 3 is a view for explaining the structure of the printer shown in FIG. 1.

FIGS. 1 to 3 illustrate a printer according to an embodiment of the present invention. FIG. 1 is a perspective view illustrating a schematic structure of the printer. FIG. 2 is a sectional side view of the printer. FIG. 3 is a view for explaining the structure of the printer.

The printer includes a ground-color-layer printing sub head 32*a*, in which a plurality of ink discharge ports for jetting ink droplets of, for example, white for printing a ground-color layer are aligned, and image printing sub heads 32*b*, 32*c*, 32*d*, and 32*e*, in which a plurality of ink discharge ports for jetting ink droplets of, for example, black, magenta, cyan, and yellow for printing an image are aligned. The sub head 32*a*, 32*b*, 32*c*, 32*d*, and 32*e* are aligned parallel to a line Y in an ink jet head 30 which is caused to perform a reciprocating movement, above a medium 10 placed on a platen 20, along the line Y parallel to a scanning direction.

Portions of the image printing sub heads 32*b*, 32*c*, 32*d*, and 32*e*, in which the plurality of ink discharge ports for jetting the ink droplets for printing an image are aligned, are positioned at a front part in an X direction of the ink jet head 30 corresponding to the direction of sending forth and moving the medium 10 on the platen 20 by the sending unit 40. Further, a portion of the ground-color-layer printing sub head 32*a*, in which the plurality of ink discharge ports for jetting the ink droplets for printing a ground-color layer are aligned, is positioned at a rear part in the X direction of the ink jet head 30 corresponding to the direction of sending forth and moving the medium 10 on the platen 20 by the sending unit 40. The above-described portion of the ground-color-layer printing sub head 32*a* is positioned to be displaced in the X direction from the portions of the image printing sub heads 32*b*, 32*c*, 32*d*, and 32*e*, in which the plurality of ink discharge ports for jetting the ink droplets for printing an image are aligned, so as not to coincide in the line Y with the above-described portions of the image printing sub heads 32*b*, 32*c*, 32*d*, and 32*e*.

Specifically, as illustrated in FIG. 3, the image printing sub heads 32*b*, 32*c*, 32*d*, and 32*e*, which are aligned in the line Y in the ink jet head 30, and in which the plurality of ink discharge ports for jetting the ink droplets for printing an image are aligned, are positioned at the front part in the X direction of the ink jet head 30 corresponding to the direction of sending forth and moving the medium 10 on the platen 20 by the sending unit 40. Further, the ground-color-layer printing sub head 32*a*, which is aligned in the line Y in the ink jet head 30, and in which the plurality of ink discharge ports for jetting the ink droplets for printing a ground-color layer are aligned, is positioned at the rear part in the X direction of the ink jet head 30 corresponding to the direction of sending forth and moving the medium 10 on the platen 20 by the sending unit 40. The above-described portion of the ground-color-layer printing sub head 32*a* is positioned to be displaced by a predetermined distance or more in the X direction from the portions of the image printing sub heads 32*b*, 32*c*, 32*d*, and 32*e*, in which the plurality of ink discharge ports for jetting the ink droplets for printing an image are aligned, so as not to coincide in the line Y with the above-described portions of the image printing sub heads 32*b*, 32*c*, 32*d*, and 32*e*.

The printer illustrated in FIGS. 1 to 3 is structured as described above. A printing method according to an embodiment of the present invention will now be described.

At a step (A) of the printing method using the present printer, the ink jet head 30 is caused to perform a reciprocating movement above the medium 10 in the line Y parallel to the scanning direction, and a ground-color layer 50 is printed into a belt shape along the line Y on the medium 10 placed on the platen 20, with the ink droplets of, for example, white jetted from the plurality of ink discharge ports which jet the ink droplets for printing a ground-color layer, and which are aligned on the ground-color-layer printing sub head 32*a* of the ink jet head 30. Thereafter, a grid roller 42 of the sending unit 40 is rotated by a predetermined angle in the X direction. Then, the medium 10, a part of which has been nipped between the grid roller 42 and pinch rollers 44, is sent forth and moved on the platen 20 in the X direction corresponding to the direction of sending forth the medium 10.

The above-described operations are then repeated to keep performing continuous printing of the ground-color layer 50 on the medium 10 in the X direction.

Subsequently, at a step (B) of the method, the step (A) of keeping performing the continuous printing of the ground-color layer 50 on the medium 10 in the X direction continues to be performed, and the medium 10 is sent forth and moved on the platen 20 by the sending unit 40 more than a predetermined number of times in the X direction corresponding to the direction of sending forth the medium 10. Then, the portions of the image printing sub heads 32*b*, 32*c*, 32*d*, and 32*e*, in which the plurality of ink discharge ports for jetting the ink droplets for printing an image are aligned, and which are positioned to be displaced in the X direction, i.e., the direction of sending forth the medium 10, from the portion of the ground-color-layer printing sub head 32*a*, in which the plurality of ink discharge ports for jetting the ink droplets for printing a ground-color layer are aligned, reach respective positions above the ground-color layer 50, which has been previously and continuously printed on the medium 10 in the X direction. Thereafter, and while continuing the step (A) of keeping performing the continuous printing of the ground-color layer 50 on the medium 10 in the X direction, an image 60 is printed along the line Y over the front surface of the ground-color layer 50, which has been previously and continuously printed on the medium 10 in the X direction, with the ink droplets jetted from the plurality of ink discharge ports which jet the ink droplets for printing an image, and which are aligned on the image printing sub heads 32*b*, 32*c*, 32*d*, and 32*e* of the ink jet head 30 that is caused to perform the reciprocating movement along the line Y. Thereafter, the medium 10 is sent forth and moved on the platen 20 by the sending unit 40 in the X direction corresponding to the direction of sending forth the medium 10.

The above-described operations are then repeated to keep performing the continuous printing of the ground-color layer 50 on the medium 10 in the X direction, and to keep performing the continuous printing of the image 60 in the X direction over the front surface of the ground-color layer 50, which has been previously and continuously printed on the medium 10.

Accordingly, when the image 60 is printed over the front surface of the ground-color layer 50, which has been previously printed on the medium 10, there is no need to move and return the medium 10, on which the ground-color layer 50 has been printed, on the platen 20 in the direction opposite to the direction of sending forth the medium 10.

Further, the following operation is removed in which the pinch rollers 44 of the sending unit 40 are rolled and returned on the ground-color layer 50 printed on the medium 10 to return in the direction opposite to the direction of sending forth the medium 10, while the pinch rollers 44 are pressed to contact the front surface of the ground-color layer 50. Thus, the ground-color layer 50 is prevented from having traces of the pinch rollers 44. Thereby, the quality of the image 60 printed over the front surface of the ground-color layer 50 is prevented from being deteriorated.

Thereafter, at a step (C) of the method, the following operation included in the step (B) is halted in which the continuous printing of the ground-color layer 50 is kept performed on the medium 10 in the X direction with the ink droplets of, for example, white jetted from the plurality of ink discharge ports which jet the ink droplets for printing a ground-color layer, and which are aligned on the ground-color-layer printing sub head 32*a* of the ink jet head 30 that is caused to perform the reciprocating movement along the line Y. At the same time, the following operation continues to be preformed in which the continuous printing of the image 60 is kept performed in the X direction over the front surface of the ground-color layer 50, which has been previously printed on the medium 10, with the ink droplets of, for example, black, magenta, cyan, and yellow jetted from the plurality of ink discharge ports which jet the ink droplets for printing an image, and which are aligned on the image printing sub heads 32*b*, 32*c*, 32*d*, and 32*e* of the ink jet head 30 that is caused to perform the reciprocating movement along the line Y. The above operation continues until an edge portion of the image 60 reaches either an edge portion of the ground-color layer 50, which has been previously and continuously printed on the medium 10 in the X direction, or a position inside the edge portion of the ground-color layer 50.

Accordingly, the image 60 is continuously printed in the X direction over the front surface of the ground-color layer 50, which has been continuously printed on the medium 10 in the X direction, with the edge portion of the image 60 reaching either the edge portion of the ground-color layer 50 or the position inside the edge portion of the ground-color layer 50.

The printing method using the printer as illustrated in FIGS. 1 and 3 includes the above-described steps (A) to (C).

Figure 4:
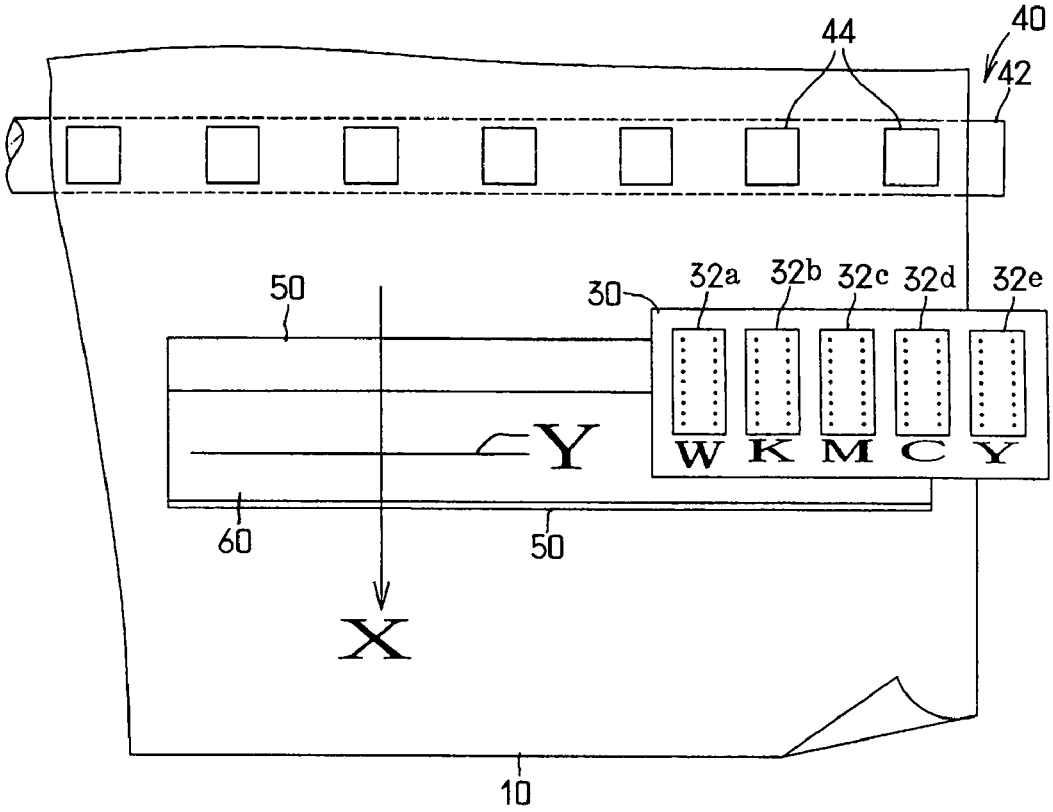
FIG. 4 is a view for explaining the structure of a printer according to another embodiment of the present invention.
Figure 5:
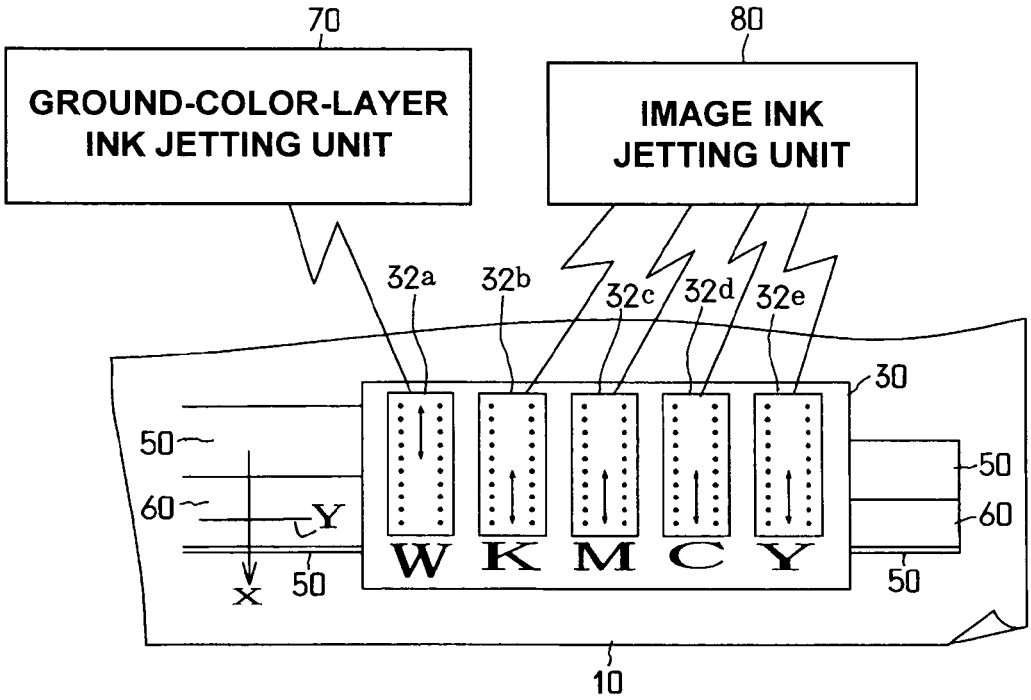
FIG. 5 is a partially enlarged view of the printer shown in FIG. 4.

FIGS. 4 and 5 illustrate a printer according to another embodiment of the present invention. FIG. 4 is a view for explaining the structure of the printer. FIG. 5 is a partially enlarged view of the printer for explaining the structure of the printer. The present printer will be described below.

The present printer includes the sub head 32*a* which jets the ink droplets of, for example, white for printing a ground-color layer, and the sub heads 32*b*, 32*c*, 32*d*, and 32*e* which jet the ink droplets of, for example, black, magenta, cyan, and yellow for printing an image. The sub head 32*a*, 32*b*, 32*c*, 32*d*, and 32*e* are aligned in the line Y in the ink jet head 30 which is caused to perform the reciprocating movement, above the medium 10 placed on the a platen 20, along the line Y parallel to the scanning direction.

Specifically, as illustrated in FIG. 5, the image printing sub heads 32*b*, 32*c*, 32*d*, and 32*e* and the ground-color-layer printing sub head 32*a* are aligned in the line Y, with no displacement in the X direction, so as to coincide with one another along the line Y. In the image printing sub heads 32*b*, 32*c*, 32*d*, and 32*e*, the plurality of ink discharge ports which jet the ink droplets for printing an image are aligned at front parts in an X direction of the sub heads (i.e., front half parts of the sub heads indicated by two-headed arrows in FIG. 5) corresponding to the direction of sending forth and moving the medium 10 on the platen 20 by the sending unit 40. In the ground-color-layer printing sub head 32*a*, the plurality of ink discharge ports which jet the ink droplets for printing a ground-color layer are aligned at a rear part in the X direction of the sub head (i.e., a rear half part of the sub head indicated by a two-headed arrow in FIG. 5) corresponding to the direction of sending forth and moving the medium 10 on the platen 20 by the sending unit 40. Further, the present printer includes image ink jetting unit 80 which jets the ink droplets for printing an image from the plurality of ink discharge ports aligned at the front parts in the X direction of the image printing sub heads 32*b*, 32*c*, 32*d*, and 32*e*, and ground-color-layer ink jetting unit 70 which jets the ink droplets for printing a ground-color layer from the plurality of ink discharge ports aligned at the rear part in the X direction of the ground-color-layer printing sub head 32*a*. The image ink jetting unit 80 and the ground-color-layer ink jetting unit 70 are formed by, for example, an electric control circuit of a host computer 100 which drives the printer.

The printer illustrated in FIGS. 4 and 5 is structured as described above. A printing method according to an embodiment of the present invention will now be described.

At a step (A) of the printing method using the present printer, the ink jet head 30 is caused to perform the reciprocating movement along the line Y parallel to the scanning direction, and a ground-color layer 50 is printed into a belt shape on the medium 10 along the line Y with the ink droplets of, for example, white jetted by the ground-color-layer ink jetting unit 70 from the plurality of ink discharge ports aligned at the rear part in the X direction of the ground-color-layer printing sub head 32*a* of the ink jet head 30. Thereafter, the medium 10 is sent forth and moved on the platen 20 by the sending unit 40 in the X direction corresponding to the direction of sending forth the medium 10. The above-described operations are repeated to keep performing the continuous printing of the ground-color layer 50 on the medium 10 in the X direction.

Subsequently, at a step (B) of the method, the step (A) of keeping performing the continuous printing of the ground-color layer 50 on the medium 10 in the X direction continues to be performed, and the medium 10 is sent forth and moved on the platen 20 by the sending unit 40 more than a predetermined number of times in the X direction corresponding to the direction of sending forth the medium 10. Then, the front parts in the X direction of the image printing sub heads 32*b*, 32*c*, 32*d*, and 32*e* of the ink jet head 30, in which the plurality of ink discharge ports for jetting the ink droplets for printing an image are aligned, reach respective positions above the ground-color layer 50, which has been previously and continuously printed on the medium 10 in the X direction. Thereafter, and while continuing the step (A) of keeping performing the continuous printing of the ground-color layer 50 on the medium 10 in the X direction, an image 60 is printed along the line Y over the front surface of the ground-color layer 50, which has been previously printed on the medium 10, with the ink droplets of, for example, black, magenta, cyan, and yellow jetted by the image ink jetting unit 80 from the plurality of ink discharge ports aligned at the front parts in the X direction of the image printing sub heads 32*b*, 32*c*, 32*d*, and 32*e* of the ink jet head 30 that is caused to perform the reciprocating movement along the line Y. Thereafter, the medium 10 is sent forth and moved on the platen 20 by the sending unit 40 in the X direction corresponding to the direction of sending forth the medium 10. The above-described operations are repeated to keep performing the continuous printing of the ground-color layer 50 on the medium 10 in the X direction, and to keep performing the continuous printing of the image 60 in the X direction over the front surface of the ground-color layer 50, which has been previously and continuously printed 50 on the medium 10 in the X direction.

Accordingly, when the image 60 is printed over the front surface of the ground-color layer 50, which has been previously printed on the medium 10, there is no need to move and return the medium 10, on which the ground-color layer 50 has been printed, in the direction opposite to the direction of sending forth the medium 10. Further, the following operation is removed in which the pinch rollers 44 of the sending unit 40 are rolled and moved on the ground-color layer 50 printed on the medium 10 to return in the direction opposite to the direction of sending forth the medium 10, while the pinch rollers 44 are pressed to contact the front surface of the ground-color layer 50. Thus, the ground-color layer 50 is prevented from having the traces of the pinch rollers 44. Thereby, the quality of the image 60 printed over the front surface of the ground-color layer 50 is prevented from being deteriorated.

Thereafter, at a step (C) of the method, the following operation included in the step (B) is halted in which the continuous printing of the ground-color layer 50 is kept performed on the medium 10 in the X direction with the ink droplets of, for example, white jetted by the ground-color-layer ink jetting unit 70 from the plurality of ink discharge ports aligned at the rear part in the X direction of the ground-color-layer printing sub head 32*a* of the ink jet head 30 that is caused to perform the reciprocating movement along the line Y. At the same time, the following operation continues to be preformed in which the continuous printing of the image 60 is kept performed in the X direction over the front surface of the ground-color layer 50, which has been previously and continuously printed on the medium 10 in the X direction, with the ink droplets of, for example, black, magenta, cyan, and yellow jetted by the image ink jetting unit 80 from the plurality of ink discharge ports aligned at the front parts in the X direction of the image printing sub heads 32*b*, 32*c*, 32*d*, and 32*e* of the ink jet head 30 that is caused to perform the reciprocating movement along the line Y. The above operation continues until an edge portion of the image 60 reaches either an edge portion of the ground-color layer 50, which has been continuously printed on the medium 10 in the X direction, or a position inside the edge portion of the ground-color layer 50.

Accordingly, the image 60 is continuously printed in the X direction over the front surface of the ground-color layer 50, which has been continuously printed on the medium 10 in the X direction, with the edge portion of the image 60 reaching either the edge portion of the ground-color layer 50 or the position inside the edge portion of the ground-color layer 50.

The printing method using the printer as illustrated in FIGS. 4 and 5 includes the above-described steps (A) to (C).

Figure 6:
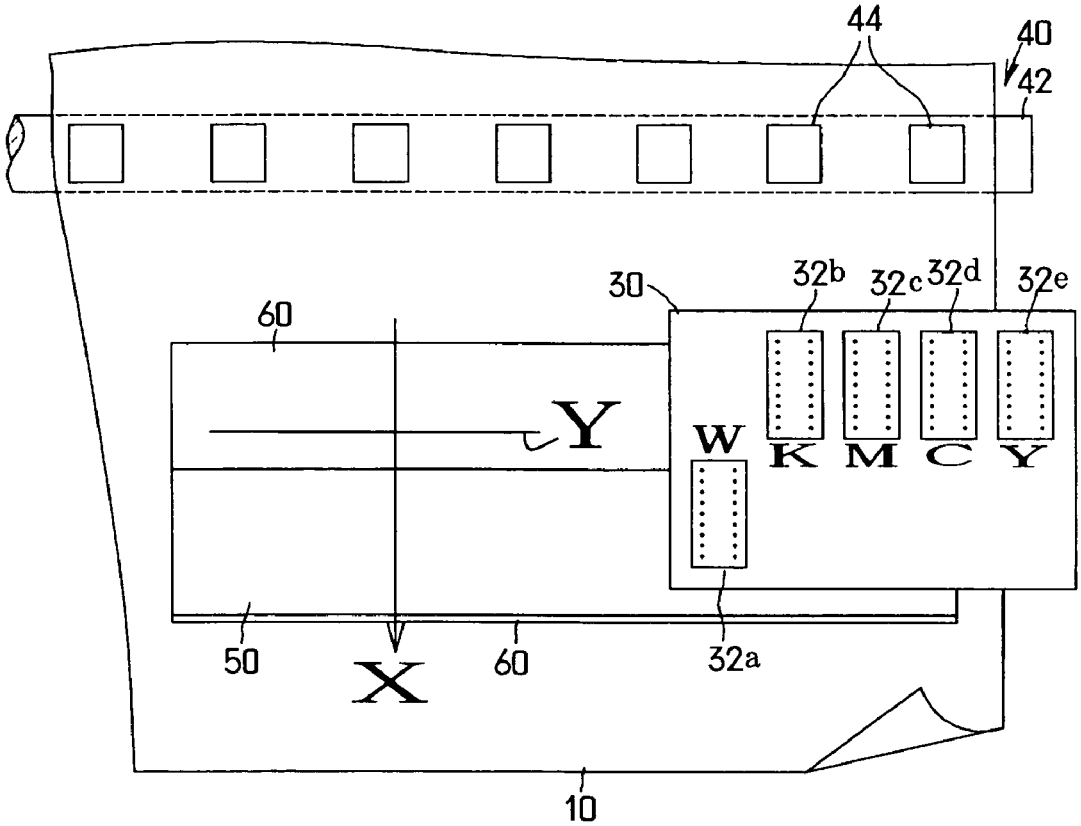
FIG. 6 is a partially enlarged view of a printer according to another embodiment of the present invention.

FIG. 6 illustrates a printer according to an embodiment of the present invention. FIG. 6 is a view for explaining the structure of the printer. The present printer will be described below.

In the present printer, the portion of the ground-color-layer printing sub head 32*a*, which is aligned along the line Y in the ink jet head 30 of the printer, and in which the plurality of ink discharge ports for jetting the ink droplets of, for example, white for printing a ground-color layer are aligned, is positioned at a front part in the X direction of the ink jet head 30 corresponding to the direction of sending forth and moving the medium 10 on the platen 20 by the sending unit 40. Further, the portions of the image printing sub heads 32*b*, 32*c*, 32*d*, and 32*e*, which are aligned along the line Y in the ink jet head 30 of the printer, and in which the plurality of ink discharge ports for jetting the ink droplets of, for example, black, magenta, cyan, and yellow for printing an image are aligned, are positioned at a rear part in the X direction of the ink jet head 30 corresponding to the direction of sending forth and moving the medium 10 on the platen 20 by the sending unit 40. The above-described portions of the image printing sub heads 32*b*, 32*c*, 32*d*, and 32*e* are positioned to be displaced in the X direction from the portion of the ground-color-layer printing sub head 32*a*, in which the plurality of ink discharge ports for jetting the ink droplets for printing a ground-color layer are aligned, so as not to coincide along the line Y with the above-described portions of the ground-color-layer printing sub head 32*a*.

Specifically, as illustrated in FIG. 6, the ground-color-layer printing sub head 32*a*, which is aligned along the line Y in the ink jet head 30, and in which the plurality of ink discharge ports for jetting the ink droplets for printing a ground-color layer are aligned, is positioned at the front part in the X direction of the ink jet head 30 corresponding to the direction of sending forth and moving the medium 10 on the platen 20 by the sending unit 40. Further, the image printing sub heads 32*b*, 32*c*, 32*d*, and 32*e*, which are aligned along the line Y in the ink jet head 30, and in which the plurality of ink discharge ports for jetting the ink droplets for printing an image are aligned, are positioned at the rear part in the X direction of the ink jet head 30 corresponding to the direction of sending forth and moving the medium 10 on the platen 20 by the sending unit 40. The image printing sub heads 32*b*, 32*c*, 32*d*, and 32*e* are positioned to be displaced by a predetermined distance or more in the X direction from the portion of the ground-color-layer printing sub head 32*a*, in which the plurality of ink discharge ports for jetting the ink droplets for printing a ground-color layer are aligned, so as not to coincide along the line Y with the above-described portion of the ground-color-layer printing sub head 32*a*.

The present printer is similar in structure to the printer illustrated in FIGS. 1 to 3 except for the point described above. A printing method according to an embodiment of the present invention will now be described.

At a step (A) of the printing method using present printer, the ink jet head 30 is caused to perform the reciprocating movement above the medium 10 along the line Y parallel to the scanning direction, and an image 60 is printed along the line Y on the medium 10 placed on the platen 20 with the ink droplets of, for example, black, magenta, cyan, and yellow jetted from the plurality of ink discharge ports which jet the ink droplets for printing an image, and which are aligned on the image printing sub heads 32*b*, 32*c*, 32*d*, and 32*e* of the ink jet head 30 of the printer. Thereafter, the grid roller 42 of the sending unit 40 is rotated by a predetermined angle in the X direction. Then, the medium 10, a part of which has been nipped between the grid roller 42 and the pinch rollers 44, is send forth and moved on the platen 20 in the X direction corresponding to the direction of sending the medium 10.

The above-described operations are then repeated to keep performing the continuous printing of the image 60 on the medium 10 in the X direction.

Subsequently, at a step (B) of the method, the step (A) of keeping performing the continuous printing of the image 60 on the medium 10 in the X direction continues to be performed, and the medium 10 is sent forth and moved on the platen 20 by the sending unit 40 more than a predetermined number of times in the X direction corresponding to the direction of sending forth the medium 10. Then, the portion of the ground-color-layer printing sub head 32*a*, in which the plurality of ink discharge ports for jetting the ink droplets for printing a ground-color layer are aligned, and which is positioned to at the front part in the X direction of the ink jet head 30 corresponding to the direction of sending forth the medium 10, to be displaced from the image printing sub heads 32*b*, 32*c*, 32*d*, and 32*e*, reaches a position above the image 60, which has been previously and continuously printed on the medium 10 in the X direction. Thereafter, and while continuing the step (A) of keeping performing the continuous printing of the image 60 on the medium 10 in the X direction, a ground-color layer 50 is printed along the line Y over the back surface of the image 60, which has been previously and continuously printed on the medium 10 in the X direction, with the ink droplets of, for example, white jetted from the plurality of ink discharge ports which jet the ink droplets for printing a ground-color layer, and which are aligned on the ground-color-layer printing sub head 32*a* of the ink jet head 30 that is caused to perform the reciprocating movement along the line Y. Thereafter, the medium 10 is sent forth and moved on the platen 20 by the sending unit 40 in the X direction corresponding to the direction of sending forth the medium 10. The above-described operations are repeated to keep performing the continuous printing of the image 60 on the medium 10 in the X direction, and to keep performing the continuous printing of the ground-color layer 50 in the X direction over the back surface of the image 60, which has been previously and continuously printed on the medium 10 in the X direction.

Accordingly, when the ground-color layer 50 is printed over the back surface of the image 60, which has been previously printed on the medium 10, there is no need to move and return the medium 10, on which the image 60 has been printed, on the platen 20 in the direction opposite to the direction of sending forth the medium 10. Further, the following operation is removed in which the pinch rollers 44 of the sending unit 40 are rolled and moved on the image 60 printed on the medium 10 to return in the direction opposite to the direction of sending forth the medium 10, while the pinch rollers 44 are pressed to contact the back surface of image 60. Thus, the image 60 is prevented from having the traces of the pinch rollers 44. Thereby, the quality of the image 60 is prevented from being deteriorated.

Thereafter, at a step (C) of the method, the following operation included in the step (B) is halted in which the continuous printing of the image 60 is kept performed on the medium 10 in the X direction with the ink droplets of, for example, black, magenta, cyan, and yellow jetted from the plurality of ink discharge ports which jet the ink droplets for printing an image, and which are included in the image printing sub heads 32*b*, 32*c*, 32*d*, and 32*e* of the ink jet head 30 that is caused to perform the reciprocating movement along the line Y. At the same time, the following operation continues to be preformed in which the continuous printing of the ground-color layer 50 is kept performed in the X direction over the back surface of the image 60, which has been previously printed on the medium 10, with the ink droplets of, for example, white jetted from the plurality of ink discharge ports which jet the ink droplets for printing a ground-color layer, and which are included in the ground-color-layer printing sub head 32*a* of the ink jet head 30 that is caused to perform the reciprocating movement along the line Y. The above operation continues until an edge portion of the ground-color layer 50 reaches either an edge portion of the image 60, which has been previously and continuously printed on the medium 10 in the X direction, or a position outside the edge portion of the image 60.

Accordingly, the ground-color layer 50 is continuously printed in the X direction over the back surface of the image 60, which has been continuously printed on the medium 10 in the X direction, with the edge portion of the ground-color layer 50 reaching either the edge portion of the image 60 or the position outside the edge portion of the image 60.

The printing method using the printer as illustrated in FIG. 6 includes the above-described steps (A) to (C).

Figure 7:
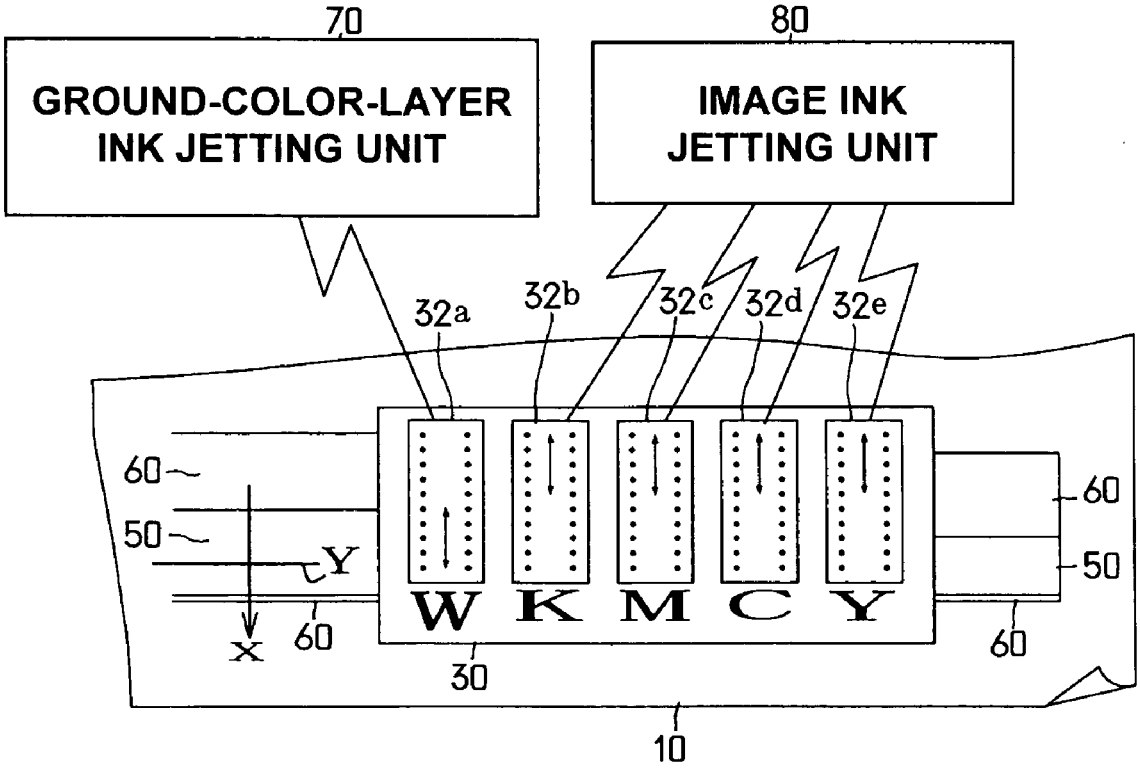
FIG. 7 is a partially enlarged view of a printer according to another embodiment of the present invention.

FIG. 7 illustrates another printer according to an embodiment of the present invention. FIG. 7 is a partially enlarged view of the printer for explaining the structure of the printer. The present printer will be described below.

In the present printer, the image printing sub heads 32*b*, 32*c*, 32*d*, and 32*e* and the ground-color-layer printing sub head 32*a* are aligned in the line Y in the ink jet head 30 so as to coincide with one another along the line Y. In the image printing sub heads 32*b*, 32*c*, 32*d*, and 32*e*, the plurality of ink discharge ports which jet the ink droplets of, for example, black, magenta, cyan, and yellow for printing an image are aligned at rear parts in the X direction of the sub heads (i.e., rear parts of the sub heads indicated by two-headed arrows in FIG. 7) corresponding to the direction of sending forth and moving the medium 10 on the platen 20 by the sending unit 40. Further, in the ground-color-layer printing sub head 32*a*, the plurality of ink discharge ports which jet the ink droplets of, for example, white for printing a ground-color layer are aligned at a front part in the X direction of the sub head (i.e., a front part of the sub head indicated by a two-headed arrow in FIG. 7) corresponding to the direction of sending forth and moving the medium 10 on the platen 20 by the sending unit 40. Further, the present printer includes the image ink jetting unit 80 which jets the ink droplets for printing an image from the plurality of ink discharge ports aligned at the rear parts in the X direction of the image printing sub heads 32*b*, 32*c*, 32*d*, and 32*e*, and the ground-color-layer ink jetting unit 70 which jets the ink droplets for printing a ground-color layer from the plurality of ink discharge ports aligned at the front part in the X direction of the ground-color-layer printing sub head 32*a*. The ground-color-layer ink jetting unit 70 and the image ink jetting unit 80 are formed by, for example, the electric control circuit of the host computer 100 which drives the printer.

The present printer is similar in structure to the printer illustrated in FIGS. 4 and 5 except for the point described above. A printing method according to an embodiment of the present invention will now be described.

At a step (A) of the printing method using the present printer, the ink jet head 30 is caused to perform the reciprocating movement along the line Y parallel to the scanning direction, and an image 60 is printed on the medium 10 in the X direction with the ink droplets of, for example, black, magenta, cyan, and yellow jetted by the image ink jetting unit 80 from the plurality of ink discharge ports aligned at the rear parts in the X direction of the image printing sub heads 32*b*, 32*c*, 32*d*, and 32*e* of the ink jet head 30. Thereafter, the medium 10 is sent forth and moved on the platen 20 by the sending unit 40 in the X direction corresponding to the direction of sending forth the medium 10. The above-described operations are repeated to keep performing the continuous printing of the image 60 on the medium 10 in the X direction.

Subsequently, at a step (B) of the method, the step (A) of keeping performing the continuous printing of the image 60 on the medium 10 in the X direction continues to be performed, and the medium 10 is sent forth and moved on the platen 20 by the sending unit 40 more than a predetermined number of times in the X direction corresponding to the direction of sending forth the medium 10. Then, the front part in the X direction of the ground-color-layer printing sub head 32*a* of the ink jet head 30, in which the plurality of ink discharge ports for jetting the ink droplets for printing a ground-color layer are aligned, reaches a position above the image 60, which has been printed on the medium 10. Thereafter, and while continuing the step (A) of keeping performing the continuous printing of the image 60 on the medium 10 in the X direction, a ground-color layer 50 is printed along the line Y over the back surface of the image 60, which has been previously printed on the medium 10, with the ink droplets of, for example, white jetted by the ground-color-layer ink jetting unit 70 from the plurality of ink discharge ports which jet the ink droplets for printing a ground-color layer, and which are aligned at the front part in the X direction of the ground-color-layer printing sub head 32*a* of the ink jet head 30 that is caused to perform the reciprocating movement along the line Y. Thereafter, the medium 10 is sent forth and moved on the platen 20 by the sending unit 40 in the X direction corresponding to the direction of sending forth the medium 10. The above-described operations are repeated to keep performing the continuous printing of the image 60 on the medium 10 in the X direction, and to keep performing the continuous printing of the ground-color layer 50 in the X direction over the back surface of the image 60, which has been previously and continuously printed on the medium 10 in the X direction.

Accordingly, when the ground-color layer 50 is printed over the back surface of the image 60, which has been previously printed on the medium 10, there is no need to move and return the medium 10, on which the image 60 has been printed, in the direction opposite to the direction of sending forth the medium 10. Further, the following operation is removed in which the pinch rollers 44 of the sending unit 40 are rolled and moved on the image 60 printed on the medium 10 to return in the direction opposite to the direction of sending forth the medium 10, while the pinch rollers 44 are pressed to contact the back surface of the image 60. Thus, the image 60 is prevented from having the traces of the pinch rollers 44. Thereby, the quality of the image 60 is prevented from being deteriorated.

Thereafter, at a step (C) of the method, the following operation included in the step (B) is halted in which the continuous printing of the image 60 is kept performed on the medium 10 in the X direction with the ink droplets jetted by the image ink jetting unit 80 from the plurality of ink discharge ports which jet the ink droplets for printing an image, and which are aligned at the rear parts in the X direction of the image printing sub heads 32*b*, 32*c*, 32*d*, and 32*e* of the ink jet head 30 that is caused to perform the reciprocating movement along the line Y. At the same time, the following operation continues to be preformed in which the continuous printing of the ground-color layer 50 in the X direction over the back surface of the image 60, which has been previously and continuously printed on the medium 10 in the X direction, with the ink droplets jetted by the ground-color-layer ink jetting unit 70 from the plurality of ink discharge ports which jet the ink droplets for printing a ground-color layer, and which are aligned at the front part in the X direction of the ground-color-layer printing sub head 32*a* of the ink jet head 30 that is caused to perform the reciprocating movement along the line Y. The above operation continues until an edge portion of the ground-color layer 50 reaches either an edge portion of the image 60, which has been continuously printed on the medium 10 in the X direction, or a position outside the edge portion of the image 60.

Accordingly, the ground-color layer 50 is continuously printed in the X direction over the back surface of the image 60, which has been continuously printed on the medium 10 in the X direction, with the edge portion of the ground-color layer 50 reaching either the edge portion of the image 60 or the position outside the edge portion of the image 60.

The printing method using the printer as illustrated in FIG. 7 includes the above-described steps (A) to (C).

In the printer, the grid roller 42 of the sending unit 40 may be configured to be rotatable both in the forward direction and the backward direction so that the medium 10 can be sent forth and moved on the platen 20 by the sending unit 40 in the X direction in either the forward direction or the backward direction according to the selected direction.

Further, in the printing method, the direction of sending forth and moving the medium 10 by using the sending unit 40 may be selected to be opposite to the direction used in the printing method as described above so that the image 60 is printed on the medium 10 and thereafter the ground-color layer 50 is printed over the back surface of the image 60.

Furthermore, the printer illustrated in FIG. 3 may be configured to have a similar effect to the effect of the printer, being capable of printing the ground-color layer 50 over the back surface of the image 60 with no need to reverse, in the X direction, the position of the ground-color-layer printing sub head 32*a*, which is positioned at the rear part in the X direction of the ink jet head 30, and the position of the image printing sub heads 32*b*, 32*c*, 32*d*, and 32*e*, which are positioned at the front part in the X direction of the ink jet head 30. Further, a printing method having a similar effect to the effect of the printing method may be provided.

Similarly, the printer illustrated in FIG. 5 may be configured to have a similar effect to the effect of the printer, being capable of printing the ground-color layer 50 over the back surface of the image 60 with no need to reverse, in the X direction, the position of the plurality of ink discharge ports which jet the ink droplets for printing a ground-color layer, and which are aligned at the rear part in the X direction of the ground-color-layer printing sub head 32*a*, and the position of the plurality of ink discharge ports which jet the ink droplets for printing an image, and which are aligned at the front parts in the X direction of the image printing sub heads 32*b*, 32*c*, 32*d*, and 32*e*. Further, a printing method having a similar effect to the effect of the printing method may be provided.

In the printer, too, the sending unit 40 may be configured to be capable of sending forth and moving the medium 10 on the platen 20 in the X direction in either the forward direction or the backward direction according to the selected direction.

Further, in the printing method, the direction of sending forth and moving the medium 10 by using the sending unit 40 may be selected to be opposite to the direction used in the printing method as described above so that the ground-color layer 50 is printed on the medium 10 and thereafter the image 60 is printed over the front surface of the ground-color layer 50.

Furthermore, the printer illustrated in FIG. 6 may be configured to have a similar effect to the effect of the printer, being capable of printing the image 60 over the front surface of the ground-color layer 50 with no need to reverse, in the X direction, the position of the image printing sub heads 32*b*, 32*c*, 32*d*, and 32*e*, which are positioned at the rear part in the X direction of the ink jet head 30, and the position of the ground-color-layer printing sub head 32*a*, which is positioned at the front part in the X direction of the ink jet head 30. Further, a printing method having a similar effect to the effect of the printing method may be provided.

Similarly, the printer illustrated in FIG. 7 may be configured to have a similar effect to the effect of the printer, being capable of printing the image 60 over the front surface of the ground-color layer 50 with no need to reverse, in the X direction, the position of the plurality of ink discharge ports which jet the ink droplets for printing a ground-color layer, and which are aligned at the front part in the X direction of the ground-color-layer printing sub head 32*a*, and the position of the plurality of ink discharge ports which jet the ink droplets for printing an image, and which are aligned at the rear parts in the X direction of the image printing sub heads 32*b*, 32*c*, 32*d*, and 32*e*. Further, a printing method having a similar effect to the effect of the printing method may be provided.

The printer may preferably include drying unit 90 for drying the ground-color layer 50 printed on the medium 10 with the ink droplets jetted from the plurality of ink discharge ports which jet the ink droplets for printing a ground-color layer, and which are aligned on the ground-color-layer printing sub head 32*a*.

Similarly, the printer may preferably include the drying unit 90 for drying the image 60 printed on the medium 10 with the ink droplets jetted from the plurality of ink discharge ports which jet the ink droplets for printing an image, and which are aligned on the image printing sub heads 32*b*, 32*c*, 32*d*, and 32*e*.

Further, it is preferable that, between the ground-color layer 50 and the image 60 which are printed over each other on the medium 10, the ground-color layer 50 or the image 60 previously printed on the medium 10 is forcefully dried by the drying unit 90.

The drying unit 90 may preferably function as a movement/standby time setting mechanism which sets the movement/standby time of the medium 10, during which the medium 10 is sent forth and moved on the platen 20 by the sending unit 40 in the X direction corresponding to the direction of sending forth the medium 10, to be a long or short time period. The drying unit 90 including the movement/standby time setting mechanism may be preferably formed by, for example, the electric control circuit of the host computer 100 which drives the printer.

The drying unit 90 may also function as a head idling mechanism which repeats an operation of causing the ink jet head 30 to perform the reciprocating movement in an idling manner along the line Y corresponding to the scanning direction, with no ink droplets jetted from the sub heads 32*a*, 32*b*, 32*c*, 32*d*, and 32*d* aligned on the ink jet head 30. The operation may be repeated during a time period in which the ground-color layer 50 is printed on the medium 10 and thereafter the image 60 is printed over the front surface of the ground-color layer 50, or during a time period in which the image 60 is printed on the medium 10 and thereafter the ground-color layer 50 is printed over the back surface of the image 60. The drying unit 90 including the head idling mechanism may be preferably formed by, for example, the electric control circuit of the host computer 100 which drives the printer.

Figure 8:
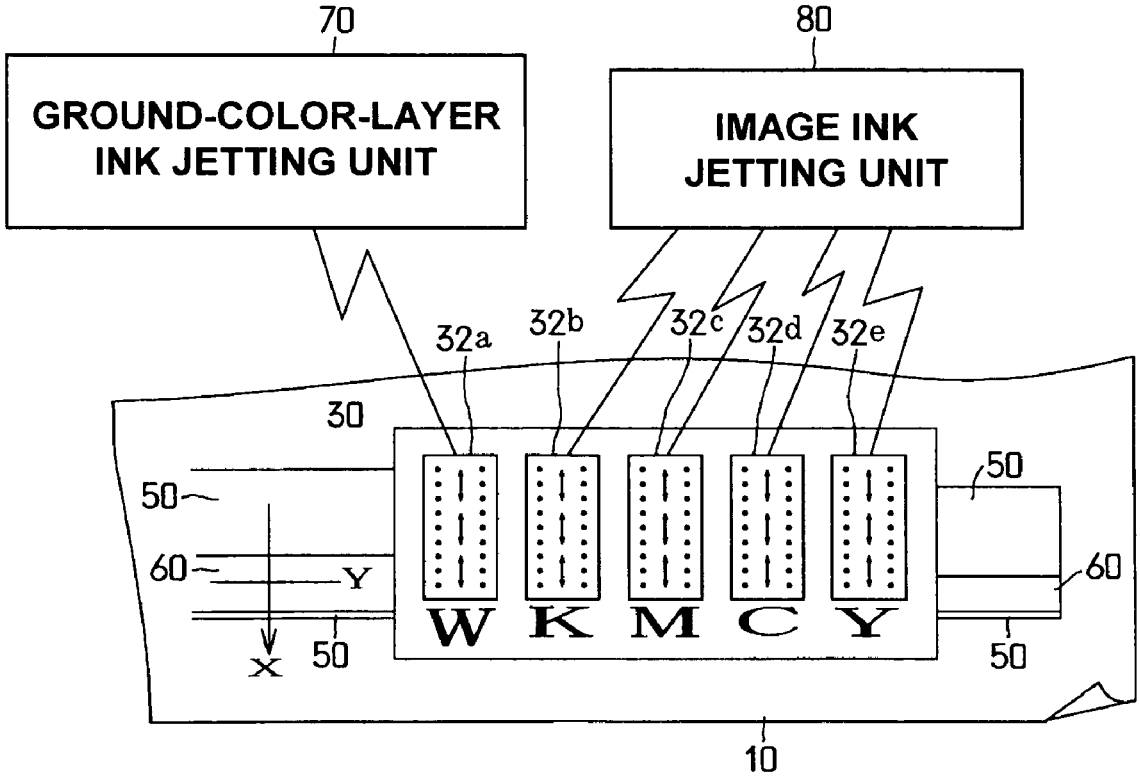
FIG. 8 is a partially enlarged view of a printer according to another embodiment of the present invention.

The drying unit 90 may also function as a distance setting mechanism which adjusts a displacement in the X direction between the image printing sub heads 32*b*, 32*c*, 32*d*, and 32*e* of the ink jet head 30, in which the plurality of ink discharge ports for jetting the ink droplets for printing an image are aligned, and the ground-color-layer printing sub head 32*a* of the ink jet head 30, in which the plurality of ink discharge ports for jetting the ink droplets for printing a ground-color layer are aligned, to be a long or short value. Alternatively, the drying unit 90 may function as a distance setting mechanism which adjusts a displacement in the X direction between the front or rear parts in the X direction of the image printing sub heads 32*b*, 32*c*, 32*d*, and 32*e* of the ink jet head 30, in which the plurality of ink discharge ports for jetting the ink droplets for printing an image are aligned, and the rear or front part in the X direction of the ground-color-layer printing sub head 32*a* of the ink jet head 30, in which the plurality of ink discharge ports for jetting the ink droplets for printing a ground-color layer are aligned, to be a long or short value, such as a distance substantially corresponding to the first third of the length in the X direction of the respective portions of the sub heads 32*a*, 32*b*, 32*c*, 32*d*, and 32*e*, in which the plurality of ink discharge ports are aligned, as indicated by two-headed arrows in FIG. 8.

Further, the drying unit 90 may be configured to sufficiently dry the image 60 or the ground-color layer 50, which has been previously printed on the medium 10, during a standby time. The standby time may be set to be a long or short time period included in a time period during which the ground-color layer 50 is printed on the medium 10 and thereafter the image 60 is printed over the front surface of the ground-color layer 50, or in a time period during which the image 60 is printed on the medium 10 and thereafter the ground-color layer 50 is printed over the back surface of the image 60.

The drying unit 90 may also function as heating and drying unit for heating and drying the ground-color layer 50 or the image 60, which has been previously printed on the medium 10, by using a heater such as an electric heater, or as hot-air heating unit for applying hot air to the ground-color layer 50 or the image 60, which has been previously printed on the medium 10, to dry the ground-color layer 50 or the image 60.

Thus, the drying unit 90 may be configured to sufficiently dry the ground-color layer 50 or the image 60, which has been previously printed on the medium 10, by using the heating and drying unit or the hot-air drying unit.

Accordingly, the image 60 may be preferably printed over the front surface of the ground-color layer 50, which has been previously printed on the medium 10 and then sufficiently dried, or the ground-color layer 50 may be preferably printed over the back surface of the image 60, which has been previously printed on the medium 10 and then sufficiently dried. Thereby, the quality of the image 60 can be preferably prevented from being deteriorated due to mixture of undried ink of the image 60 and the ground-color layer 50 which are printed over each other.

In the printer, the ground-color-layer printing sub head 32*a* may be changed into a sub head which jets ink droplets for printing an image-fixing undercoat layer from the ink discharge ports which jet the ink droplets for the ground-color layer.

Thus, when it is difficult to directly and stably fix and print the image 60 on the medium 10, an undercoat layer (not illustrated) for fixing the image 60 may be printed on the medium 10 by using the printer and a printing method similar to the printing method, so that the image 60 is stably and securely fixed and printed over the front surface of the undercoat layer, and that the quality of the image 60 printed over the front surface of the undercoat layer is improved.

In the printer, the ground-color-layer printing sub head 32*a* may be changed into a sub head which jets ink droplets for printing an overcoat layer for protecting the image 60 from the ink discharge ports which jet the ink droplets for the ground-color layer.

Thus, by using the printer and a printing method similar to the printing method, the image 60 may be printed on the medium 10 and thereafter the front surface of the image 60, which has been printed on the medium 10, may be protected by an overcoat layer (not illustrated) so that the weather resistance of the image 60 is improved.

The printer according to the embodiments of the present invention and the printing method according to the embodiments of the present invention can be widely used to print an image on a transparent medium, such as a film and glass, or on a medium which is difficult to be directly printed with an image, such as a resin sheet, fabric, and leather.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An ink-jet printer comprising:

an ink-jet head comprising:

an image printing head configured to print an image on a medium and having a plurality of image printing ink discharge ports configured to discharge ink to print the image during a layered printing operation;

a ground-color-layer printing head configured to print a ground-color-layer on the medium and having a plurality of ground-color-layer printing ink discharge ports configured to discharge ink to print the ground-color-layer during the layered printing operation, the medium and the ink-jet head being configured to relatively move parallel to a first line and along a second direction substantially perpendicular to the first line, a position on the ink-jet head of all of said plurality of ground-color-layer printing ink discharge ports configured to be used during the layered printing operation being displaced from a position on the ink-jet head of all of said plurality of image printing ink discharge ports configured to be used during the layered printing operation along the first line and the second direction; and a dryer configured to at least partially dry the ground-color-layer or the image after printing thereof and before respective printing of the image or the ground-color-layer thereon during the layered printing operation.

2. The ink-jet printer according to claim 1, wherein the ink-jet head is configured to move parallel to the first line, the medium is configured to move in the second direction, and all of said plurality of image printing ink discharge ports configured to be used during the layered printing operation are positioned on the ink-jet head ahead of all of said plurality of ground-color-layer printing ink discharge ports configured to be used during the layered printing operation in the second direction.

3. The ink-jet printer according to claim 2, further comprising:

an ink-jet controller configured to operate the ground-color-layer printing head to print the ground-color-layer on the medium and configured to operate the image printing head to print the image on the ground-color-layer.

4. The ink-jet printer according to claim 1, wherein the ink-jet head is configured to move parallel to the first line, the medium is configured to move in the second direction, and all of said plurality of ground-color-layer printing ink discharge ports configured to be used during the layered printing operation are positioned on the ink-jet head ahead of all of said plurality of image printing ink discharge ports configured to be used during the layered printing operation in the second direction.

5. The ink-jet printer according to claim 4, further comprising:

an ink-jet controller configured to operate the image printing head to print the image on the medium and configured to operate the ground-color-layer printing head to print the ground-color-layer on the image.

6. The ink-jet printer according to claim 1, wherein the dryer comprises a moving speed controller configured to control a moving speed of the medium in the second direction.

7. The ink-jet printer according to claim 1, wherein the dryer comprises a head idling mechanism configured to prohibit the ink-jet head from jetting ink for a predetermined period of time.

8. The ink-jet printer according to claim 1, wherein the dryer comprises a heater.

9. The ink-jet printer according to claim 1, wherein the dryer comprises a hot-air heating unit.

10. An ink-jet printer comprising:

an ink-jet head comprising:

an image printing head configured to print an image on a medium and having a plurality of image printing ink discharge ports configured to discharge ink to print the image during a layered printing operation; and a ground-color-layer printing head configured to print a ground-color-layer on the medium and having a plurality of ground-color-layer printing ink discharge ports configured to discharge ink to print the ground-color-layer during the layered printing operation, the medium and the ink-jet head being configured to relatively move parallel to a first line and along a second direction substantially perpendicular to the first line, a position on the ink-jet head of all of the plurality of ground-color-layer printing ink discharge ports configured to be used during the layered printing operation being displaced from a position on the ink-jet head of all of the plurality of image printing ink discharge ports configured to be used during the layered printing operation along the first line and the second direction;

a dryer configured to at least partially dry the ground-color-layer or the image after printing thereof and before respective printing of the image or the ground-color-layer thereon during the layered printing operation; and a jetting controller configured to jet from said part of the plurality of ground-color-layer printing ink discharge ports and said part of the plurality of image printing ink discharge ports.

11. An ink-jet printer comprising:

an ink-jet head comprising:

image printing means for printing an image on a medium and having a plurality of image printing ink discharge ports configured to discharge ink to print the image during a layered printing operation; and ground-color-layer printing means for printing a ground-color-layer on the medium and having a plurality of ground-color-layer printing ink discharge ports configured to discharge ink to print the ground-color-layer during the layered printing operation, the medium and the ink-jet head being configured to relatively move parallel to a first line and along a second direction substantially perpendicular to the first line, a position on the ink-jet head of all of said plurality of ground-color-layer printing ink discharge ports configured to be used during the layered printing operation being displaced from a position on the ink-jet head of all of said plurality of image printing ink discharge ports configured to be used during the layered printing operation along the first line and the second direction; and means for at least partially drying of the ground-color-layer or the image after printing thereof and before respective printing of the image or the ground-color-layer thereon during the layered printing operation.

12. A printing method comprising:

printing a ground-color-layer on a medium using an ink-jet head;

at least partially drying of the ground-color-layer; and printing an image on the at least partially dried ground-color-layer printed on the medium using the ink-jet head comprising:

an image printing head having a plurality of image printing ink discharge ports configured to discharge ink to print the image during a layered printing operation; and a ground-color-layer printing head having a plurality of ground-color-layer printing ink discharge ports configured to discharge ink to print the ground-color-layer during the layered printing operation, the medium and the ink-jet head being configured to relatively move parallel to a first line and along a second direction substantially perpendicular to the first line, a position on the ink-jet head of all of said plurality of ground-color-layer printing ink discharge ports configured to be used during the layered printing operation being displaced from a position on the ink-jet head of all of said plurality of image printing ink discharge ports configured to be used during the layered printing operation along the first line and the second direction.

13. A printing method comprising:

printing an image on a medium using an ink-jet head;

at least partially drying of the image; and printing a ground-color-layer on the at least partially dried image printed on the medium using the ink-jet head comprising:

an image printing head having a plurality of image printing ink discharge ports configured to discharge ink to print the image during a layered printing operation; and a ground-color-layer printing head having a plurality of ground-color-layer printing ink discharge ports configured to discharge ink to print the ground-color-layer during the layered printing operation, the medium and the ink-jet head being configured to relatively move parallel to a first line and along a second direction substantially perpendicular to the first line, a position on the ink-jet head of all of said plurality of ground-color-layer printing ink discharge ports configured to be used during the layered printing operation being displaced from a position on the ink-jet head of all of said plurality of image printing ink discharge ports configured to be used during the layered printing operation along the first line and the second direction.

* * * * *